US006047723A

United States Patent [19]

Hoeptner, III

[11] Patent Number: 6,047,723

[45] Date of Patent: Apr. 11, 2000

[54] POSITIVE DISPLACEMENT YARD HYDRANT

[76] Inventor: Herbert W. Hoeptner, III, 7796 Oak Springs Cir., Gilroy, Calif. 95020

[21] Appl. No.: 09/033,756

[22] Filed: Mar. 3, 1998

[51] Int. Cl.[7] ..... E03B 9/04; E03B 9/14

[52] U.S. Cl. ..... 137/281; 137/287; 137/301

[58] Field of Search ..... 137/281, 282, 137/292, 294, 295, 301, 59, 62

[56] References Cited

U.S. PATENT DOCUMENTS

| | | | |
|---|---|---|---|
| 196,384 | 10/1877 | Porteous | 137/282 |
| 519,728 | 5/1894 | McGowan | 137/533.19 |
| 888,941 | 5/1908 | Traxel | 137/281 |
| 1,250,388 | 12/1917 | Titus | 251/36 |
| 1,786,357 | 12/1930 | Miller | 137/892 |
| 1,987,883 | 1/1935 | White et al. | 137/304 |
| 2,580,199 | 12/1951 | Schmid | 137/301 |
| 2,598,968 | 6/1952 | Boosey | 137/282 |
| 2,605,781 | 8/1952 | Schmid et al. | 137/282 |
| 2,664,096 | 12/1953 | Murdock et al. . | |
| 3,017,896 | 1/1962 | Papacek . | |
| 3,770,003 | 11/1973 | Uroshevich . | |
| 3,885,585 | 5/1975 | Carpentier . | |
| 3,926,206 | 12/1975 | Anderson et al. | 137/281 |
| 3,926,207 | 12/1975 | Anderson et al. | 137/281 |
| 4,096,877 | 6/1978 | Arledge | 137/281 |
| 4,109,671 | 8/1978 | Hughes et al. . | |
| 4,202,526 | 5/1980 | Muller et al. | 251/51 |
| 4,282,895 | 8/1981 | Young | 137/281 |
| 4,653,521 | 3/1987 | Fillman . | |
| 4,653,522 | 3/1987 | Fillman et al. . | |
| 4,854,339 | 8/1989 | Hoeptner, III . | |
| 5,033,500 | 7/1991 | Hoeptner, III . | |
| 5,261,441 | 11/1993 | Anderson | 137/281 |
| 5,355,907 | 10/1994 | Hoeptner, III . | |
| 5,451,030 | 9/1995 | Reglebrugge et al. | 251/52 |
| 5,701,925 | 12/1997 | Mulligan et al. . | |

OTHER PUBLICATIONS

"Merrill SP Pitless Units", Merrill Manufacturing, Storm Lake, IA "Campbell M1 Pitless Adapters", Campbell Manufacturing, Inc.

"Campbell M4 Pitless Adapters", Campbell Manufacturing, Inc., Bechtelsville, PA.

*Primary Examiner*—George L. Walton

*Attorney, Agent, or Firm*—William W. Haefliger

[57] ABSTRACT

A yard hydrant comprising a cylinder, and a piston movable up and down in the cylinder in association with water flow into and out of a reservoir in the cylinder; tubular structure associated with the piston and extending upwardly from the piston and downwardly from the piston, and movable therewith; supply structure to deliver water from a source into the tubular structure for flow upwardly therein and delivery above the piston and cylinder when the piston is in a first position relative to the cylinder; there being porting carried by the tubular structure to drain water into the reservoir within the cylinder below the piston, when the piston is moved to a second position relative to the cylinder; and an actuator above the piston and cylinder to effect displacement of the piston and between up and down positions.

14 Claims, 3 Drawing Sheets

POSITIVE DISPLACEMENT YARD HYDRANT

BACKGROUND OF THE INVENTION

This invention relates generally to freeze-resisting valves, and more particularly to valves installable in such relation to the ground as to resist freeze-up in cold weather.

Freezing of water control valves in winter, as for example in remote locations, such as farms, ranches, etc., has been a persistent problem. There is need for a simple, reliable valve that does not require heating, as by electricity or other means, and that will resist, and prevent, freeze-up in normal winter conditions.

SUMMARY OF THE INVENTION

It is a major object of the invention to provide a very simple, reliable, and improved yard hydrant apparatus to meet the above need. Basically, the hydrant of the invention comprises:

a) a cylinder to be located underground, and a piston movable up and down in the cylinder in association with water flow into and out of a reservoir, b) tubular means associated with the piston and extending upwardly from the piston and downwardly from the piston, and movable therewith, c) supply means to deliver water from a below-ground source into the tubular means for flow upwardly therein and delivery above the piston and cylinder when the piston is in a first position relative to the cylinder, d) there being porting carried by the tubular means to drain water from within the tubular means into the reservoir within the cylinder below the piston, when the piston is moved to a second position relative to the cylinder, e) and an actuator above the piston and cylinder to effect displacement of the piston and between first and second positions.

The water in the reservoir does not freeze due to the fact that the reservoir is underground and in contact with the ground to receive ground stored heat.

As will appear, the underground reservoir typically extends about the porting in the tubular means, and remains in communication with such porting as the piston is moved downwardly, whereby water in the hydrant reservoir is displaced into the tubular means for upward delivery, even in very cold weather.

Another object is to provide a supply means duct having communication with the interior of the tubular means in the piston down position, and blanked against such communication in the piston up position. As will appear, the cylinder may have a lower tubular extent receiving the tubular means below the piston, the cylinder lower tubular extent having a side wall port via which water is supplied to the interior of the tubular means in the piston down position, the side wall port blanked by the tubular means in the piston up position.

The porting in the tubular means preferably communicates with the side wall port in the piston down position, and communicates with the reservoir in the cylinder, in piston up position.

A further object includes provision of the cylinder to have an upper tubular extent that receives the piston, the cylinder lower tubular extent having reduced diameter relative to the cylinder upper tubular extent. Accordingly, the reservoir is located above the cylinder lower tubular extent; and heat from the sub-surface formation may pass by conduction upwardly into the reservoir, from below the reservoir.

An additional object is to provide a pipe connected to the cylinder and extending upwardly to support the actuator, the tubular means extending upwardly within the pipe for up and down movement therein.

These and other objects and advantages of the invention, as well as the details of an illustrative embodiment, will be more fully understood from the following specification and drawings, in which:

DRAWING DESCRIPTION

DETAILED DESCRIPTION

Figure 1:
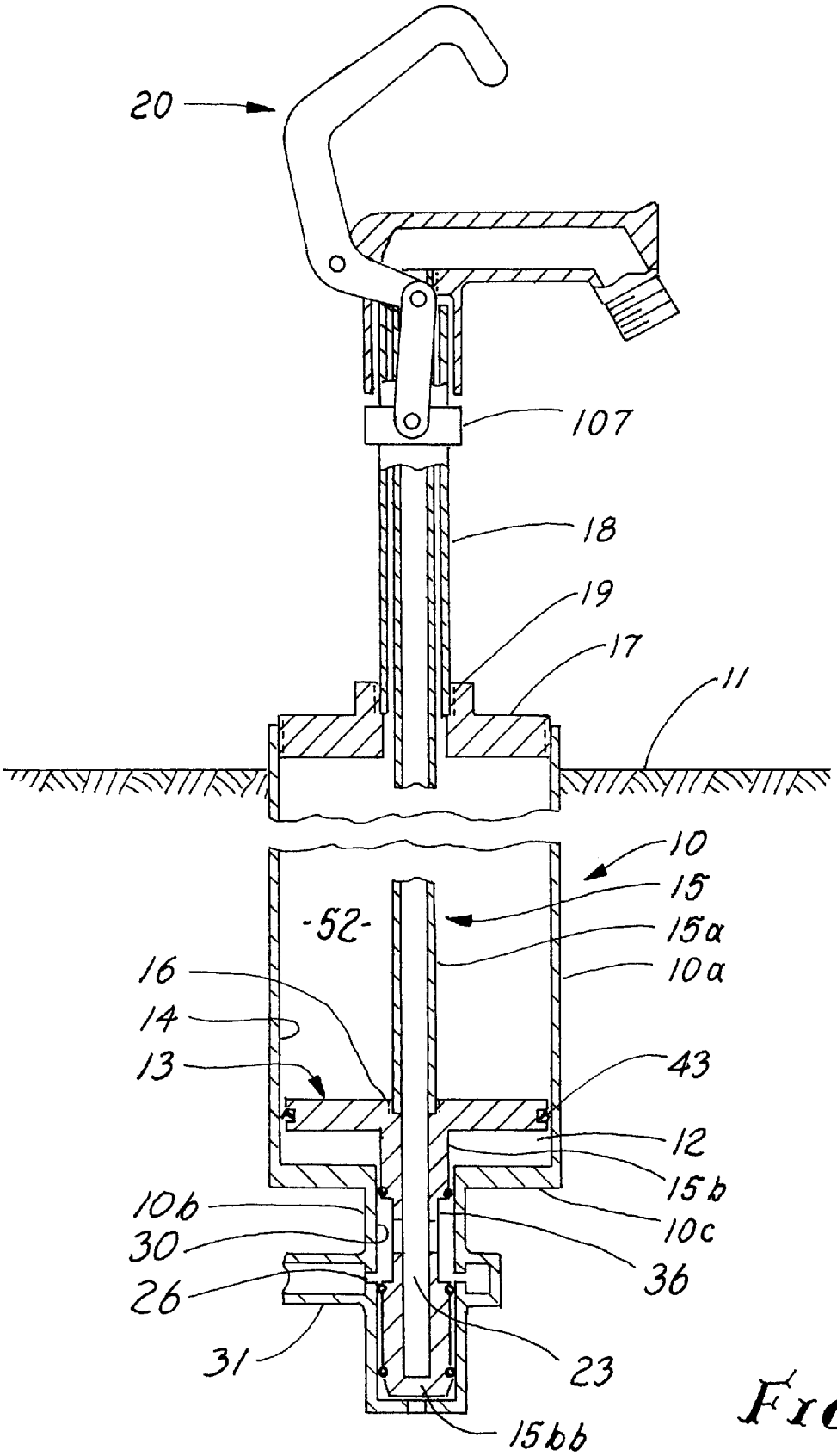
FIG. 1 is a vertical section showing one preferred form of apparatus embodying the invention, and in piston down position.

In the drawings, the vertically elongated, hollow body 10 may be cylindrical, as shown. It is adapted to be installed underground, below ground surface level 11. Heat from the underground formation is conducted to and into the cylindrical body 10, as via its side wall 10*a* and bottom wall 10*c*, which may be metallic. Accordingly, water stored in a reservoir 12 in the lower body does not freeze, despite freezing conditions at and above ground surface level 11.

A piston 13 is shown as received in a bore 14 defined by body 10, to be movable up and down; and it will be understood that as the piston moves downwardly, water stored in the reservoir 12 is displaced through porting 34 into and upwardly within tubular means 15 associated with the piston. That tubular means extends upwardly from the piston, and also downwardly, as at locations 15*a* and 15*b*.

As shown, lower portion 15*b* may be integral with the piston; and upper portion 15*a* may comprise a tube connected to the piston at 16. Tube 15*a* extends upwardly through a closure 17 closing the upper end of the cylinder 10, and also within a pipe 18 attached to the closure at 19, and extending upwardly to an above ground location, as at 18*a*. Tube 15*a* projects upwardly beyond the upper end of pipe 18 and is movable up and down by an actuator 20, for stroking the piston 13 up and down. Fitting 100, connected to the top of tube 15*a*, delivers water at outlet 101, as the tube 15*a* is moved downwardly.

Supply means is provided to deliver water from a below-ground source into the tubular means for flow upwardly therein and delivery above the piston and cylinder when the piston is in a down position relative to the cylinder. Such supply means typically has communication with the interior 23 of the tubular means lower portion 15*b* in piston down position (see FIGS. 1 and 3) and is blanked against said communication in piston up position (see FIG. 2). Note, for example, the side wall port 26 in the lower tubular extent 10*b* integral with cylinder 10, and which receives the tubular means lower portion 15*b* projecting downwardly as shown to move within a bore 30 defined by 10*b*.

An underground water supply pipe appears at 31 is and is in communication with port 26. Lower portion 15*b* of the tubular means 15 has a closed lower end at 15*bb*. Lower tubular extent 10*b* may have a drain opening at 32 in its bottom wall 10*bb*.

Figure 2:
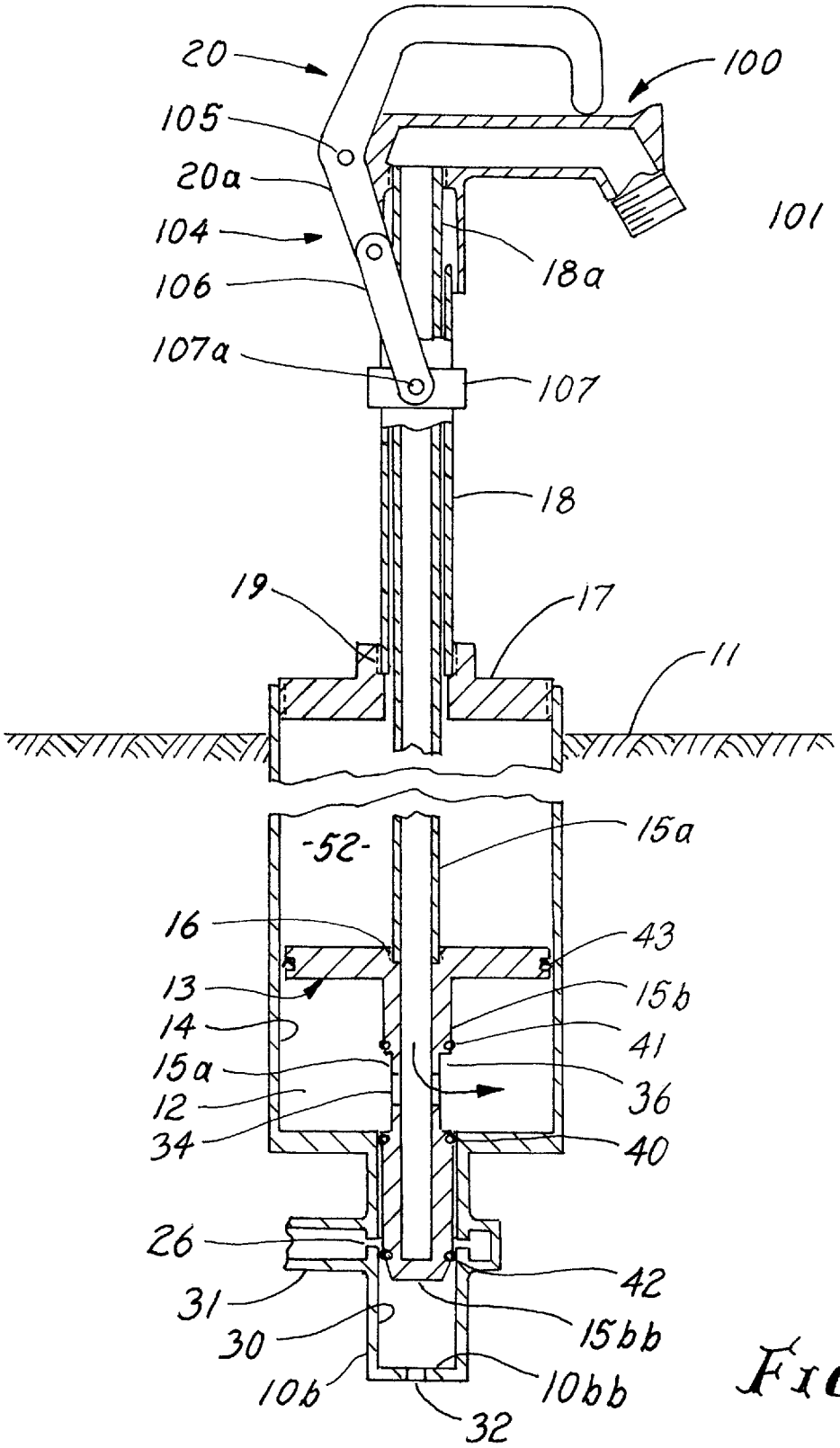
FIG. 2 is a view like FIG. 1 but showing the in apparatus in piston up position.

Porting is provided in the tubular means lower portion 15*b*, as at 34, to drain water from within the tubular means into a reservoir within the cylinder below the piston, when the piston is moved to an up position relative to the cylinder. Accordingly, any water remaining above ground level in the upper tubular portion 15*a* drains through porting 34, and into the underground reservoir 12 as indicated in FIG. 2, to prevent freezing of water in 15*a*. The hydrant is, therefore, usable in winter as well as other seasons, no water remaining above ground to freeze in 15*a* above ground.

It will be noted that porting 34 is positioned sufficiently close to the piston 13 as to receive water from the reservoir during downward movement of the piston. Elongated clearance is provided for this purpose, as at 36, between the reduced outer diameter 15*d* of the tubular lower portion 15*b*, and bore 30 of 10*b*, to pass water to the porting 34 as it travels below the level of the reservoir 12 on piston down stroking. Seals 40 and 41 are carried by 15*b* above and below that clearance, to engage bore 30, and a bottom seal 42 below the level of porting 26 also engages bore 30, as in FIG. 2. A piston seal appears at 43.

Actuator 20 has pivot connection at 105 to the fitting 100; and a link 106 pivotally connects the lower arm 20*a* of the actuator to a sleeve 107 attached by set screw 107*a* to fixed pipe 18 when set screw 107*a* is released, pull up of 100 pulls 107 off 18, after 17 is removed from 10. As actuator 20 is swung counterclockwise, the tubular means 15 and piston 13 are moved downwardly to enable hydrant water flow; and as 20 is swung clockwise, 15 and 13 move upwardly to stop such flow.

Figure 3:
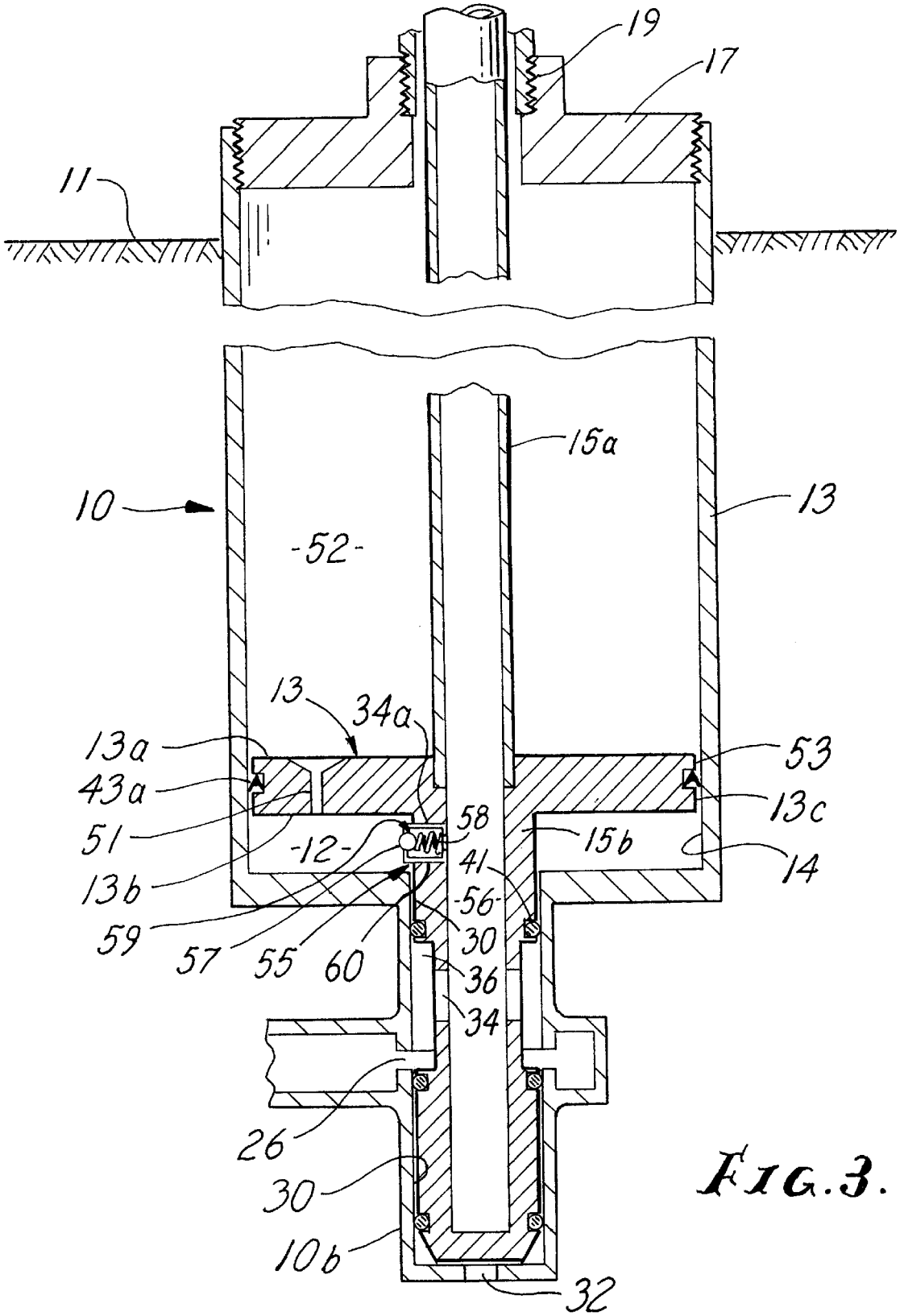
FIG. 3 is an enlarged vertical section showing details of the lower underground portion of the modified apparatus in piston down position.

FIG. 3 shows one modified form of the FIG. 1 and FIG. 2 apparatus, and wherein corresponding elements bear the same identifying numerals. A through port 51 through the piston 13, between its upper and lower surfaces 13*a* and 13*b*, allows some water under pressure to flow upwardly from reservoir 12 to the chamber 52 above the piston, during the piston down-stroke. Also, port 51 allows water to drain from chamber 52 into the reservoir, at times when the piston is in the up-position, as seen in FIG. 2, to prevent water freezing in chamber 52.

In another form, a slight, annular clearance 53 between the piston periphery 13*c* and bore 14 allows air to pass between 52 and 14 during the piston up-stroke. Note the chevron seal 43*a*, which accommodates such air passage, but blocks water flow upwardly through the clearance, during the piston down-stroke.

A check valve unit 55 in said other form is then carried within a port 34*a* in portion 15*b* of the tubular means, immediately below the piston. That unit 55 allows water to flow from the reservoir 12 into the bore 56 of the tubing 15 during the down-stroking of the piston and particularly after seal 41 travels downward in engagement with bore 30; however, it blocks reverse water flow from tubing bore 56 into the reservoir 12. The unit includes a ball check 57 resiliently urged by spring 58 against a seat 59 in a tubular insert 60. That insert is carried in port 34*a*, as shown. When the port 51 is employed, the check valve unit 55 need not be used, and vice versa.

In piston up-position, water can flow from pipe 15*a* to the reservoir, via elongated clearance at 36.

I claim:

1. In a yard hydrant, the combination comprising:

a) a cylinder, and a piston movable up and down in the cylinder in association with water flow into and out of a reservoir in the cylinder, b) a tubular means associated with the piston and extending upwardly from the piston and downwardly from the piston, and movable therewith, c) a supply means to deliver water from a source into the tubular means for flow upwardly therein and delivery above the piston and cylinder when the piston is in a first position relative to the cylinder, to discharge water from the hydrant, d) a porting means carried by said tubular means to drain water into the reservoir within the cylinder below the piston, when the piston is moved to a second position relative to the cylinder, to block water flow from the hydrant, e) and an actuator above the piston and cylinder to effect displacement of the piston and between said positions, f) said porting means being moved within said reservoir in said second position, and being moved outside the reservoir in said first position, g) the supply means having sideward communication via the porting means with the interior of the tubular means above the bottom of said tubular means when said porting means is outside the reservoir, and said sideward communication being blocked when the porting means is disposed within the reservoir, whereby water within the tubular means above the reservoir can drain back into the reservoir to prevent freezing.

h) the bottom of the tubular means remaining closed in all positions of the tubular means.

2. The combination of claim 1 wherein the supply means has sideward communication with the interior of the tubular means above the bottom of said tubular means in the piston first position, said tubular means skipped below said porting means to pass water to said porting means in said first position.

3. The combination of claim 2 wherein said cylinder has a lower tubular extent receiving said tubular means below the piston, said cylinder lower tubular extent having a side wall port via which water is supplied to the interior of the tubular means in piston first position, the side wall port closed by the tubular means in said piston second position.

4. The combination of claim 3 wherein said porting means is in a wall of the tubular means and communicates with the cylinder side wall port in piston first position, and communicates with the reservoir in the cylinder, in piston second position.

5. The combination of claim 3 wherein the cylinder has an upper tubular extent that receives the piston, the cylinder lower tubular extent having reduced diameter relative to the cylinder upper tubular extent.

6. The combination of claim 1 wherein the actuator has operative connection to the tubular means extending upwardly from the piston.

7. The combination of claim 6 including a pipe connected to said cylinder and extending upwardly to support the actuator, the tubular means extending upwardly within the pipe for up and down movement therein.

8. The combination of claim 1 wherein said porting means in the tubular means is positioned sufficiently close to the piston as to receive and pass water from the reservoir during downward movement of the piston in the cylinder.

9. The combination of claim 8 wherein the tubular means has reduced outer diameter along a length thereof at and above said porting means, to provide for water flow from the reservoir to said porting means as the porting means is moved downwardly below the level of the reservoir.

10. The combination of claim 1 including a port in the piston to pass water between the reservoir and the interior of the cylinder above the piston, during piston stroking.

11. The combination of claim 1 including a clearance passage between the piston and a bore defined by the cylinder, to pass air to said reservoir from the interior of the cylinder above the piston, during up-stroking of the piston.

12. The combination of claim 11 including a flexible chevron seal at said clearance passage to seal-off said clearance passage during down-stroking of the piston.

13. The combination of claim 1 including a check valve unit carried by said tubular means to pass water from the reservoir into the tubular means during down-stroking of the piston.

14. The combination of claim 13 including a cylinder lower tubular extension having a bore that receives lower extent of said tubular means, there being a seal sealing off between said bore and said lower extent of the tubular means, said check valve unit located above said seal.

* * * * *

UNITED STATES PATENT AND TRADEMARK OFFICE

CERTIFICATE OF CORRECTION

PATENT NO. : 6,047,723
DATED : April 11, 2000
INVENTOR(S) : Herbert W. Hoeptner, III It is certified that error appears in the above-identified patent and that said Letters Patent is hereby corrected as shown below:

Column 4,
Line 32; "first position, said tubular means skipped below said porting" should read -- first position, said tubular means extending below said porting --.

Signed and Sealed this

Twenty-fourth Day of July, 2001

*Attest:*

Nicholas P. Godici

*Attesting Officer*

NICHOLAS P. GODICI
*Acting Director of the United States Patent and Trademark Office*